US005238251A

United States Patent [19]

Staka

[11] Patent Number: 5,238,251

[45] Date of Patent: Aug. 24, 1993

[54] VOLLEYBALL TRAINING AND MONITORING APPARATUS

[76] Inventor: Robert L. Staka, 136 La Colinas Dr., Watsonville, Calif. 95076

[21] Appl. No.: 962,126

[22] Filed: Oct. 16, 1992

[51] Int. Cl.[5] ..... A69B 69/00

[52] U.S. Cl. ..... 273/411; 273/58 C; 273/413

[58] Field of Search ..... 273/411, 413, 58 C

[56] References Cited

U.S. PATENT DOCUMENTS 4,706,964 11/1987 Genovese ..... 273/413
4,881,742 11/1989 Hargreave ..... 273/413
5,060,946 10/1991 Taylor ..... 273/411

*Primary Examiner*—William H. Grieb
*Attorney, Agent, or Firm*—Jeffrey A. Hall

[57] ABSTRACT

A volleyball training and monitoring apparatus comprising a base and an upright support member connected to the base and extending upward from the base. The upright support member has an inner member slideably secured therein and extendably adjustable by a handle secured to a notched element operably engaged to a gear housing a sprocket engaged with the inner upright member. A volleyball is supported and positioned by an arm secured to a cam and cam follower assembly mounted on the upright member which provides instant feedback to the user if a correct hit or incorrect hit of the volleyball is made by allowing rotation of the arm if a correct hit is made, while limiting arm movement if an incorrect hit is made. An angle adjustment apparatus is secured to the upright support member and to the arm. The angle adjustment apparatus includes a positioning plate having angle markings thereon and an angle locating disk including a plurality of spaced detents for positioning and alignment of the disk with the angle marking on the positioning plate allowing control of the angle at which the arm and volleyball are positioned.

18 Claims, 5 Drawing Sheets

VOLLEYBALL TRAINING AND MONITORING APPARATUS

BACKGROUND OF THE INVENTION

1. Field of Invention

This invention relates to sport practice apparatuses and systems, and more particularly to volleyball training and monitoring apparatuses.

2. Description of Prior Art

In recent years volleyball has experienced tremendous growth in popularity, both as a spectator and as a participant sport. Numerous practice devices have been proposed and implemented for developing and polishing skills such as spiking, serving, blocking, jumping, and the like. Unfortunately all are significantly limited in function and application.

In the sport of volleyball spike plays, accurate hitting of the volley ball, and correct jumping and positioning are perhaps the most important and difficult skills to learn and perfect. It is difficult to coach and teach the skills required in volleyball since the plays involve quick striking and spiking of the volleyball often completed in a jumping position off of the floor. To be effective, the coach must be extremely vigilant and observant of the player's foot work, arm and trunk motion, and of course, where the struck ball goes. Of great importance are jumping height and position of the player, the quality of hit, and hand and wrist orientation at ball impact. All of these observations are difficult, if not impossible to make on a consistent basis. Moreover, prior to the present invention there was no practice apparatus available which could be aligned anywhere on a volleyball court, or elsewhere, where height, angle, and tension adjustments could be made to simulate delivery of the ball to anywhere on the court, and indicate a correct hit by its action.

Various volleyball practice apparatuses have been proposed and implemented. For example, training apparatuses have been developed to support a game ball at a selected elevation for practice purposes. A typical volleyball training apparatus includes an upright post extending from a weighted base. A lateral arm extends outward from the post to a ball support. Such apparatuses provide no means to adjust the height and/or tension of the ball, nor do they provide any feedback to the user to indicate when a correct or an incorrect hit has been made.

A further problem with current ball supporting apparatus is that the ball, to be positioned at the jump height of the user, necessitates use of a stepladder or chair beside the ball support in order to position the ball, which of course, is both obstructive and distractive to the user. Variations of such devices include the use of a tethered ball. In such devices, a volleyball is tethered to a tether line which is secured to the support and is restricted in movement, after being hit, by the tether line. This provides a solution of sorts to the loading problem, but adds further problems in that tethers do not allow the ball to move along its natural flight path, provide no means for height, angle, or tension adjustments of the ball, nor provide any feedback information to the user regarding the quality of the hit, spike, serve, etc., being practiced. Moreover, the tether type device has a tendency to inhibit or obstruct a hit or stroke to the correct impact area of the ball, which may in fact lead to diminished performance by the user of such devices.

Another genre of practice apparatus are the conventional ball setting apparatuses. Because the physical capabilities and height of individual players vary, the setting height of the ball for effective training must be easily and readily adjustable. Apparatuses which provide for such ready adjustments have not been previously available. Numerous forms of ineffective interlocking telescoping arrangements using set screw and the like have been utilized. While such apparatuses function adequately to select an operating height of the ball support, most are cumbersome and difficult to operate. Consequently, coaches and players often set such training devices at a preselected height thus requiring all players to practice at such height, which may have little or nothing to do with the height at which they need to practice.

Therefore, known apparatuses do not satisfactorily provide a volleyball practice means for practicing crucial aspects of the sport, such as spiking, serving, hitting, jumping, approach to the ball, and other crucial skills. Nor do known apparatuses provide for height, angle, or tension adjustments so as to simulate delivery of a volleyball to anywhere on the opposite side of the court, or have means to indicate a correct or incorrect hit by the apparatuses action.

Accordingly, it is a primary object of this invention to provide an improved volleyball training and monitoring apparatus designed so that it can be aligned anywhere on a court and including height, angle, and tensions adjustment means enabling the user to simulate delivery of a ball to anywhere on the opposite side of the court.

It is a further objective of the invention to provide a volleyball training and monitoring apparatus with means to indicate directly to the user whether a correct or an incorrect hit has been made.

Additional objects and advantages of the invention will be set forth in the description which follows, and in part will be obvious from the description, or may be learned by practice of the invention. The objects and advantages of the invention may be realized and obtained by instrumentalities and combinations particularly pointed out in the appended claims.

SUMMARY OF THE INVENTION

To achieve the foregoing objects, and in accordance with the purposes of the invention as embodied and broadly described herein, a volleyball training and monitoring apparatus, comprising: a base, an upright support member connected to said base and extending upwardly from the base, said upright support member having an inner upright member slideably secured therein and extending upwardly therefrom; height adjustment means for said upright support member operably secured to the upright support member and to said inner upright member; means for supporting and positioning a volleyball, including arm means positioned in a generally horizontal orientation to the upright support member; means for controlling the position and movement of said volleyball comprising a cam and spring loaded follower means operably secured to the upright support member and to said arm means; and angle adjustment means for positioning and adjusting the arm means at a desired angle including positioning means and angle indicator means coupled thereto.

The means for controlling the position and movement of said volleyball preferably includes a compression spring means secured to a cam follower arm having a pivot mounted to a pivot block, said pivot block is secured to a plate means; said compression spring is springably engaged to adjustment knob means, allowing for control and monitoring of the volleyball movement and providing tension and torque control means for said arm means. Positioning means are preferably provided by a positioning plate having angle markings thereon and locking means for securing the positioning plate at a desired angle. Angle indicator means are preferably provided by a locating disk having a plurality of spaced detents thereon for positioning and alignment corresponding to said angle markings on said positioning plate; the locating disk is preferably secured between said positioning plate and a backing plate.

In accordance with the purposes of the invention, there is also provided a game ball support and training apparatus, comprising: a base; an upright support member connected to said base and having extension means for raising and lowering said upright support member; height adjustment means operably secured to the upright support member for height adjustments of the upright support member; means for supporting and positioning said game ball including an arm positioned in a substantially horizontal orientation to the upright support member; means for controlling the position and movement of the game ball including a cam and tension control means operably attached to the upright support member and to said arm, and angle adjustment means for locating and positioning the arm at a desired angle, whereby the game ball may be positioned to simulate delivery of the game ball to a desired location when correctly struck.

Height adjustment means preferably comprise a handle secured to a worm element, said worm element is operably coupled with worm gear housing having a sprocket operably mounted therein and engaged with said inner upright member. The means for supporting and positioning said game ball preferably comprise an arm being preferably flexible and having slots therein to maintain said arm in a parallel position within base plate means so that when the game ball is struck in a correct manner the impact imparts force perpendicular to said base plate thereby smoothly rotating said cam and said ball, indicating to the user a correct hit. Conversely, an incorrect hit results in the arm wobbling up and down slightly but not rotating smoothly, if at all, around said cam so the user instantly knows he or she has hit the ball incorrectly.

BRIEF DESCRIPTION OF THE DRAWINGS

The accompanying drawings, which are incorporated in and constitute part of the specification, illustrate a preferred embodiment of the invention and, together with a general description given above and the detailed description given below, serve to explain the principles of the invention.

DETAILED DESCRIPTION OF THE PREFERRED EMBODIMENTS

Reference will now be made in detail to the present preferred embodiments of the invention illustrated in the accompanying drawings.

In accordance with the present invention, there is provided a volleyball training and monitoring apparatus, comprising: a base; an upright support member connected to said base and extending upwardly from the base, said upright support member having an inner upright member slideably secured therein and extending upwardly therefrom; height adjustment means for said upright support member operably secured to the upright support member and to said inner upright member; means for supporting and positioning a volleyball, including arm means positioned in a generally horizontal orientation to the upright support member; means for controlling the position and movement of said volleyball comprising a cam and a spring loaded follower means operably secured to the upright support member and to said arm means; and, angle adjustment means for positioning and adjusting the arm means at a desired angle including positioning means and angle indicator means coupled thereto.

Figure 1:
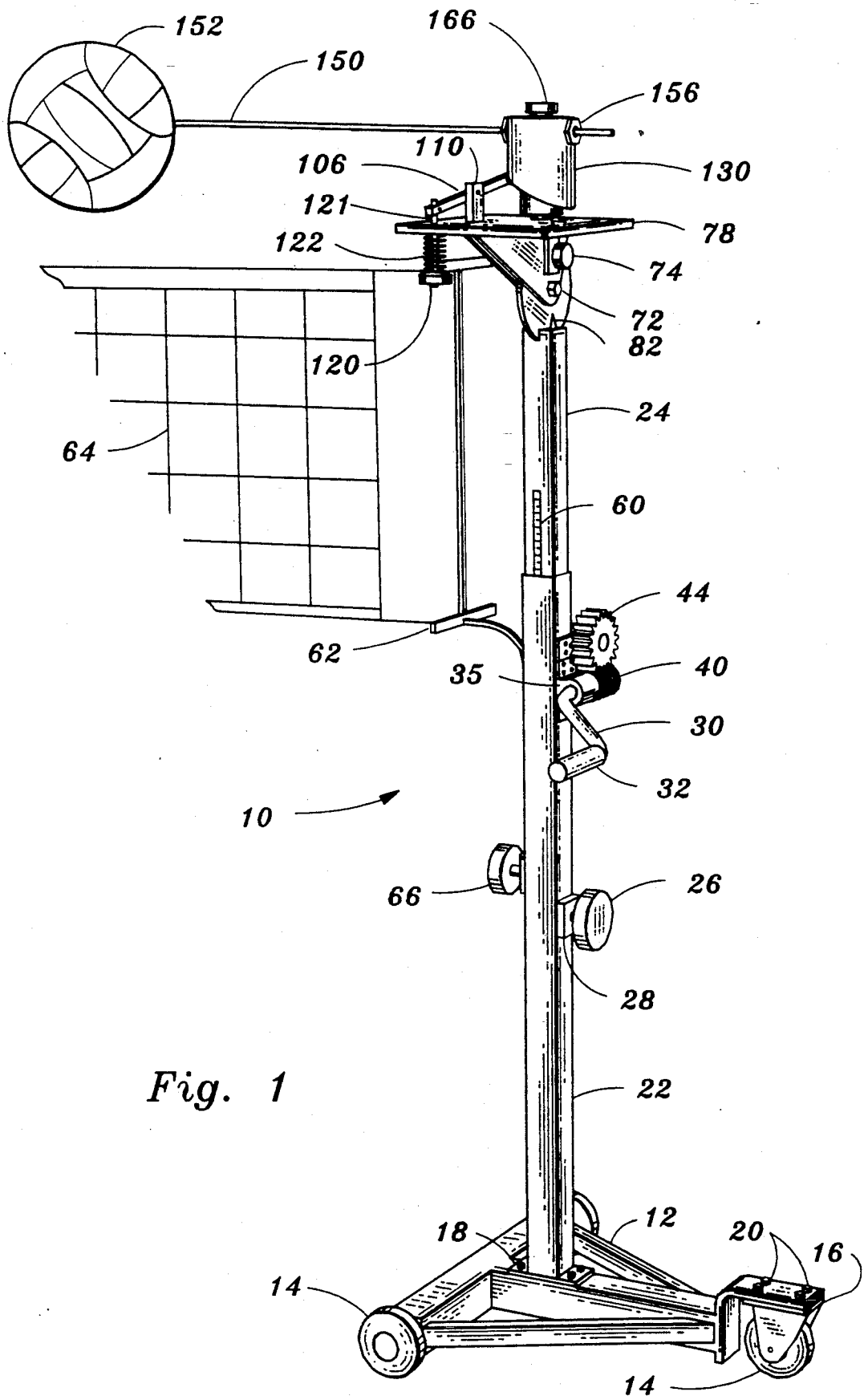
FIG. 1 is a side view of an embodiment of a volleyball training and monitoring apparatus incorporating the teaching of the present invention.

In FIG. 1, the volleyball training and monitoring apparatus is shown as apparatus 10 having base 12, wheels 14 rotatably mounted to base 12, a pivoting locking wheel mechanism 16, operably coupled thereto, and an upright flanged member 18 secured to base 12 by bolts 18 for detachably securing an upright support member 22 therein. The upright support member 22 is preferably composed of a durable, resilient material such as metal, plastic, composite, or the like, and has inner upright member 24 slideably secured therein and extending upwardly therefrom. Height adjustment means are provided for upright support 22 and inner upright member 24 by a handle driven sprocket 46 which engages with apertures 54 in inner upright member 24 and driven by a notched element or worm 40 operably engaged with a worm or notched gear 44 to prevent back slippage of sprocket 46. A handle 30 is operably coupled with worm 40 and preferably has rotating grip 32 retained by snap ring keeper 34, and handle housing 35, best seen in FIG. 3. By rotating handle 30 worm 40 drives worm gear 42 and sprocket 46 which raises or lowers inner upright member 24 as desired. The handle and sprocket mechanism illustrated in FIGS. 1 to 4 may be replaced with other alternative mechanisms of raising or lowering apparatus 10, such as a motor driven support member raising and lowering device, or other conventional mechanical means well known in the art.

Inner upright member 24 preferably includes a scale 60 for height indication of apparatus 10, which in the preferred embodiment, is calibrated with the ball holding means so that the user has a direct and convenient reading of the height at which the ball is positioned. Upright support member 22 may have a net attachment, such as adjustable net 64 secured to upright member 22 by upright element 62 which is positioned and secured by knob fastener 66. Net 64 may be set on either side of support member 22 to accommodate both left and right handed players, to alert the players to fouls at the net, and to accommodate different heights of individual players such as for boys and girls teams.

Figure 3:
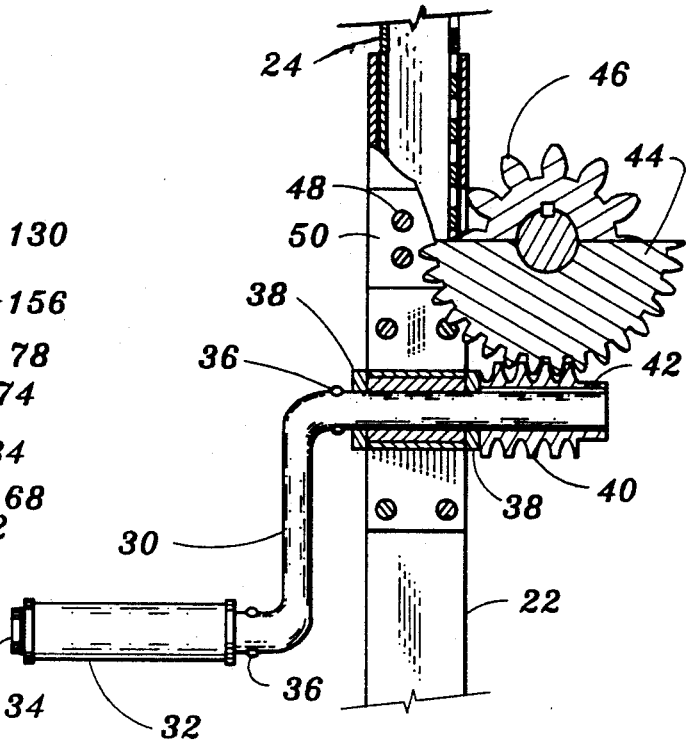
FIG. 3 is an exploded front view of a handle and height adjustment means of such apparatus, according to the invention.
Figure 4:
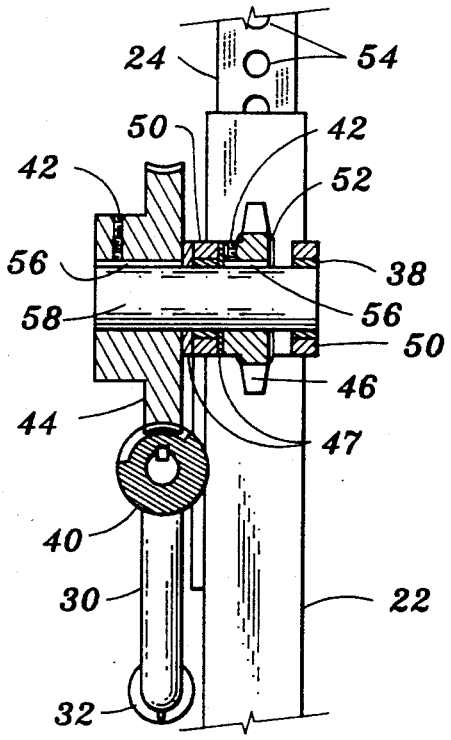
FIG. 4 is an exploded side view of a handle and height adjustment means of such apparatus, according to the invention.

Referring specifically now to FIGS. 3 and 4 a detail of the preferred height adjustment means are illustrated in exaggerated fashion for clarity. In FIG. 3 handle 30 is preferably secured in upright support member 22 and bushing 38 is provided for thrust generated by action of worm 40., which are preferably self-lubricating bushings, elevations 36, set screws 42, and screws 48. The rotating grip 32 is also preferably secured in place by elevations or pinches 36 best seen in FIG. 3. FIG. 4 shows an exaggerated sectional view of sprocket 46, shaft 58, bushing 38, bracket 50, key 56, and clearance aperture 52 for sprocket 46. The preferred combination of handle 30 driving worm 40, worm gear 44, sprocket 46, and washer 47 provide a smooth, efficient, and safe mechanism for adjusting the height of apparatus 10.

Figure 2:
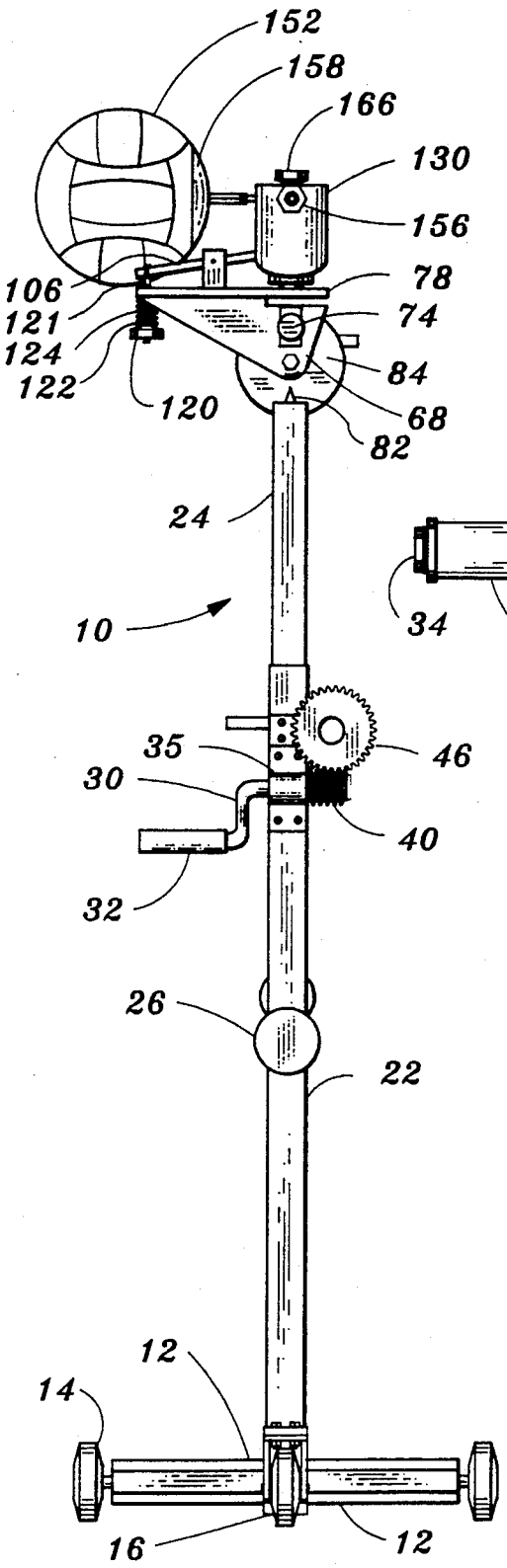
FIG. 2 is a front view of such embodiment, according to the invention.
Figure 6:
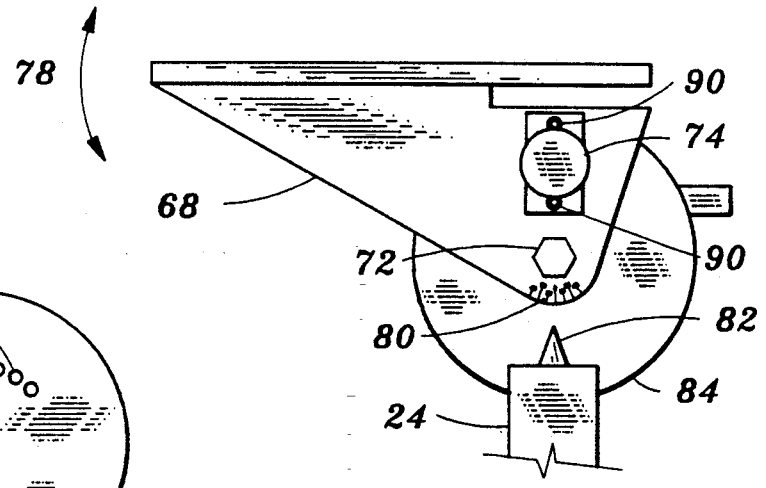
FIG. 6 is an exploded view of an angle positioning plate of such apparatus, according to the invention.
Figure 5:
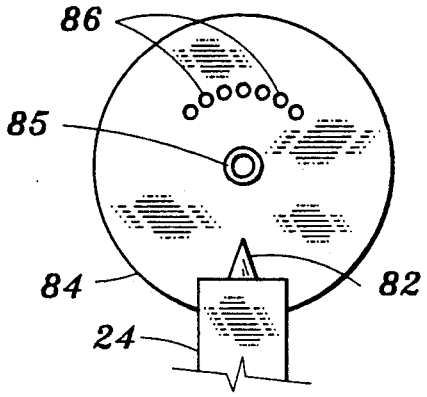
FIG. 5 is an exploded view of an angle locating disk of such apparatus, according to the invention.

As shown in FIGS. 1 and 2, and in greater detail in FIGS. 5 and 6, angle adjustment means for adjusting the angle at which ball 158 is held are attached to inner upright support member 24 and comprise locating disk 84 preferably welded to inner upright member 24, however, screws, bolts, and other conventional fastening means may also be used. Pointer 82 on member 24 indicates angles designated on angle markings 80 on positioning plate 68 thereby providing positioning means for apparatus 10. Locating disk 84 is preferably secured to positioning plate 68 and to a backing plate 70 by bolt 72 and cotter pin 73, but may be otherwise. Threaded knob 74 locks into detents 86 for positioning ball 152 at a desired angle, and is secured to the positioning plate by block 102, screws 90, washer 92, and welds 88, so as to secure knob 74 in position when adjusting the angle of positioning plate 68. However, other conventional fastening means such as bolts, adhesives, rivets, or the like may alternatively be used. Positioning plate 68 and backing plate 70 are secured to cam support base plate 78 by welds 88, however, bolts, screws, adhesives, or other fastening means maybe substituted therefore. In FIG. 5, inner upright member 24 is shown with locating disk 84 having bushing 85, preferably a self-lubricating bushing, and detents 86. FIG. 6 shows an exploded view of positioning plate 68 for clarity, with angle indicator markings 80, locating disk 84, pointer 82, and cam support base plate 78.

Figure 7:
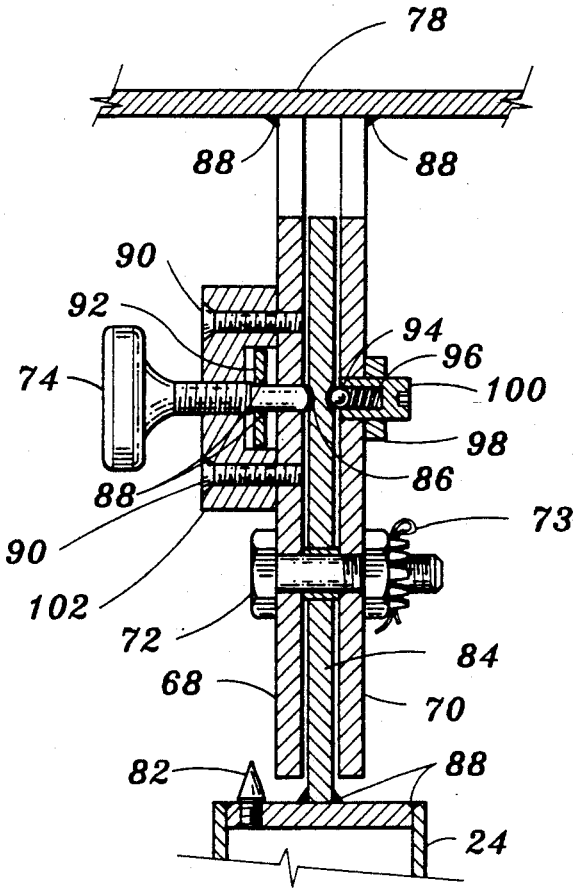
FIG. 7 is an exploded sectional view of an angle adjustment means of such apparatus, according to the invention.

Referring now to FIG. 7, a sectional view of positioning plate 68, backing plate 70, knob 74 for locking detents at a desired angle is shown. A spring loaded ball assembly for securing and indexing positioning plate 68 and locating disk 84 at a desired angle comprises ball 94 operably coupled to spring 96, and secured in housing 100, which is preferably threaded to receive retaining lock nut 98. Bolt 72, preferably a pivot bolt, is tightened and secured with a cotter pin 73, to prevent binding or loosening of bolt 72. Spacer bushings are also shown in FIG. 7 around the shaft of bolt 72.

Figure 8:
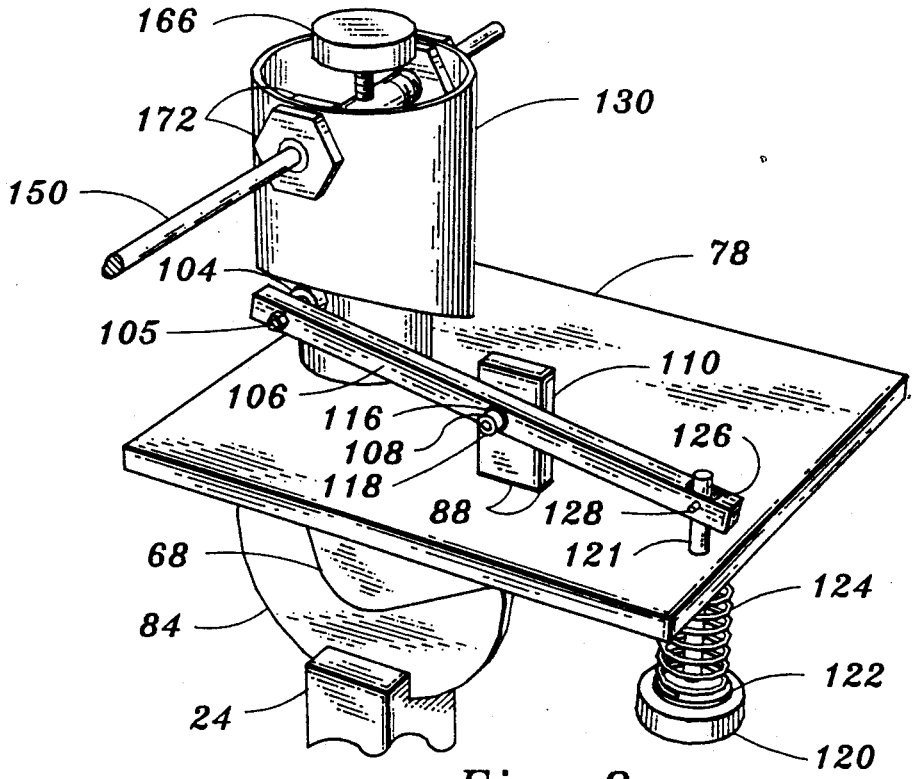
FIG. 8 is an exploded view of controlling and positioning means of such apparatus, according to the invention.
Figure 12:
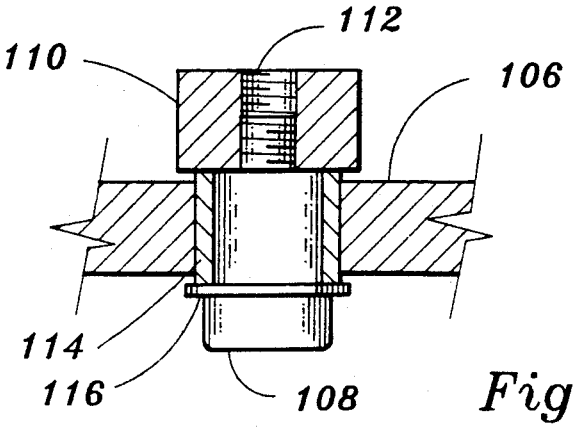
FIG. 12 is an exploded view of a pivot mounting block of a cam follower of such apparatus, according to the invention.

As shown in FIG. 8, means for controlling the position and movement of ball 152 are provided, in the preferred embodiment, by a cam 130, and a cam follower 104 secured to cam follower arm 106 by bolt 105. Cam follower 105 preferably has a standard needle bearing on the stud and is sealed and pre-lubricated for smooth and efficient operation. Pivot 108 is secured to pivot block 110 having threaded aperture 112 and secured thereto by bolt 118 and includes, in the preferred embodiment, shoulder bolt pivot 108 and bushing 114. Pivot block 110 is preferably welded to cam support plate 78, however, other fastening means may also be utilized such as bolts, screws, rivets, and the like. Cam follower arm 106 is pivotally secured to shaft 121 with pin 128. Adjustment knob 120, washer 122, and tension spring 124 provide tension adjustment means for apparatus 10. A pivot pin 128 pivotally secures cam follower arm 106 to shaft 121. Cam follower arm 106 preferably includes a slotted opening 126 for clearance of shaft 121. In FIG. 12, a detail of cam follower arm 106 at pivot 108 is illustrated. Pivot mounting block 110 has threads 112 and washer 116 for bolt 108. Bushings 114 are preferably self-lubricating and of greater length than the thickness of cam follower arm 106, and protrude slightly from both sides of arm 106 to prevent wear on the arm.

Figure 9:
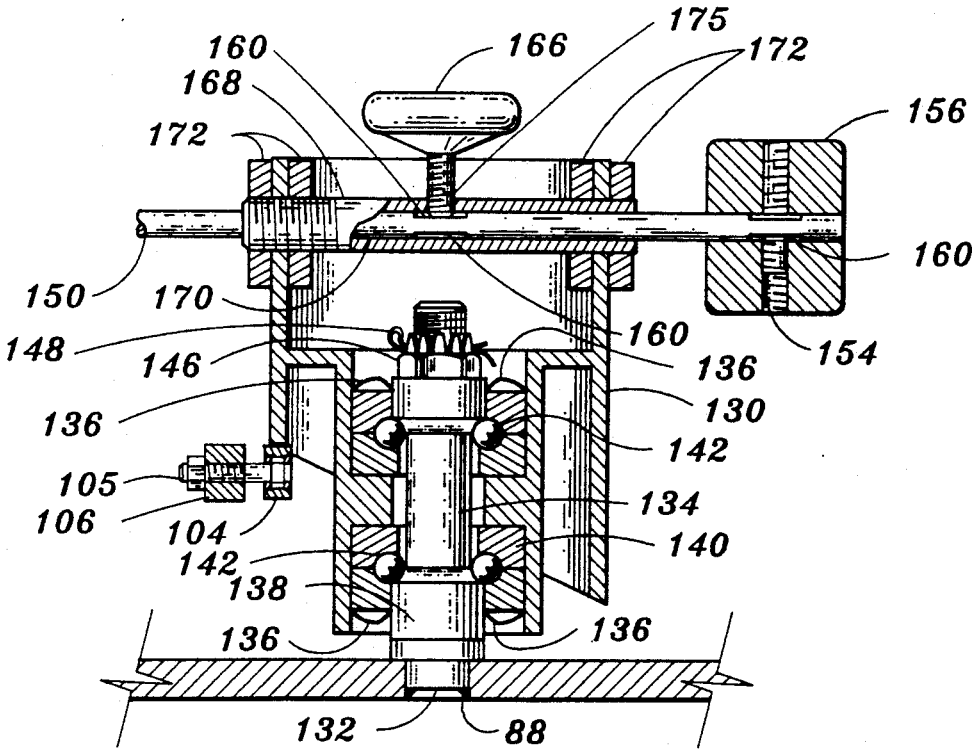
FIG. 9 is a sectional view of a cam and arm support of such apparatus, according to the invention.

Cam 130 is secured on plate 78 and is operably coupled with cam follower arm 106 and ball support arm 150 providing both positioning and control means for ball 152 secured to support arm 150. Best seen in FIG. 9 is the linkage of ball support arm 150 cam 130, support plate 78, and slots 160 in arm 150. The positioning and support means provided by cam 130, cam follower arm 106, and ball support arm 150, are preferably adjusted so that when a user strikes ball 152 in a correct fashion, ball support arm rotates about spindle 134 smoothly, while an incorrect hit produces an attenuated, wobbly movement of arm support 150, immediately indicating to the user that the ball has been incorrectly hit. What is a correct hit is determined by the settings of positioning plate 68, locating disc 84 and the setting of support arm 150 in cam 130, and of course, may be varied to correspond to the purpose and training requirements of the user. To accomplish this, ball support arm 150 is secured in cam 130 by knob 166 which is preferably engaged in slots 160 in arm 150 as shown in FIG. 9. Slots 160 and knob 166 function to keep ball support arm parallel to base plate 78 so a correct hit will impact perpendicular to plate 78 resulting in a smooth rotation of the cam. Spindle 134 is secured to plate 78 by plug 132 which is preferably welded thereto, however, other conventional fastening means may be used as well, such as bolts, screws, rivets, and the like. Seal 136 is secured to inner race 138 and spindle bearings 142 are preferably secured to spindle 134 and to outer race 140. Spindle 134 is preferably secured by nut 146 with cotter pin 148 to pre-load bearings 142. Counterweight 156 may be used in conjunction with the spring tension on cam 130 to allow cam rotation by users with less physical strength, and is secured to ball support arm 150 by screws, but may be otherwise secured. Support bushing 168 is shown secured by nut 172, and with knob 166 tightening and securing ball support arm 150 in a parallel orientation to base plate 78 allowing rotation of arm 150 as a result of striking ball 152 parallel to base plate 78 which is angularly adjusted by positioning plate 68 and locating disk 84.

Figure 10:
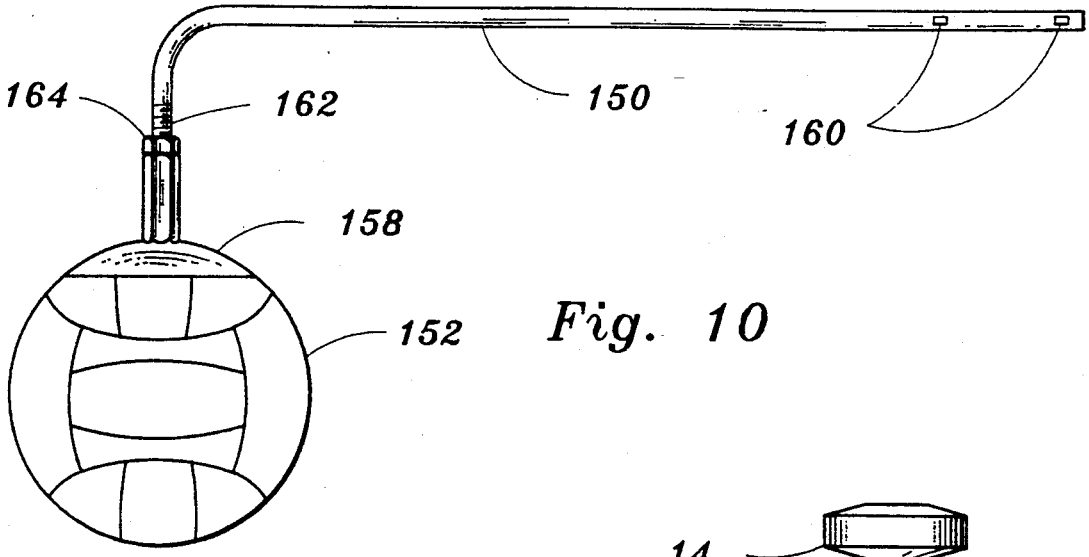
FIG. 10 is an exploded top view of an arm and volleyball retaining means of such apparatus, according to the invention.

Referring now to FIG. 10, preferred means for supporting and positioning ball 152 comprise flexible ball support arm 150 with slots 160 for coupling with cam 130, and ball support cup 158 for securing and positioning ball 152 on arm 150. In the preferred embodiment arm 150 is threaded with threads 162 to attach locking nut 164 for securing and positioning ball support cup 158. Cup 158 is preferably composed of a durable, flexible material such as rubber or thermoplastics. In FIG. 10, ball support cup 158 is configured to hold a volleyball therein, however, if apparatus 10 is used for other sports, with a differently configured game ball, alternative configurations of cup 158 would be used. Slots 160 are preferably flat and positioned 180 degrees from each other as shown in FIGS. 9 and 10 allowing for rotating arm 150 of apparatus 10 for use by either left or right handed players. In the preferred embodiment as illustrated in FIG. 10 ball support arm 150 is shown with a 90 degree bend on the ball retaining end thereof.

Figure 11:
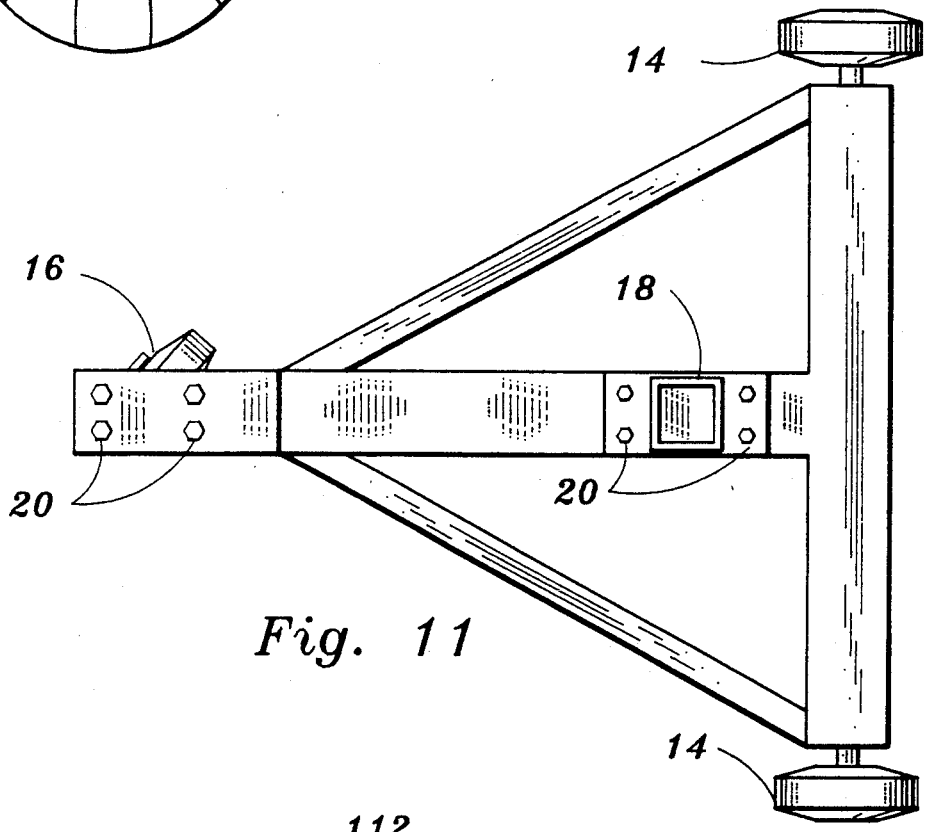
FIG. 11 is a top view of a base of such apparatus, according to the invention.

As shown in FIG. 11, base 12 has wheels 14 rotatably attached thereto for facilitating movement of apparatus 10. A pivoting and locking wheel 16 is preferably provided to aid in alignment of apparatus on a playing court and to prevent unwanted movement of apparatus 10 while in use. Flange 18 is shown attached by bolts 20, however, other conventional fastening means may be substituted without departing from the spirit of the invention.

In operation and use volleyball training and monitoring apparatus 10 is extremely efficient for learning the correct approach to the ball and the correct position of the body and arm at impact with the ball from any position on a court. Apparatus 10 may be used anywhere on a volleyball court to simulate delivery of a ball to anywhere on the opposite side of the court while indicating immediately to the user whether a correct or an incorrect hit has been made. Moreover, the concept embraced by the present invention and illustrated in the embodiments described is applicable to other sports as well as volleyball, such as tennis, soccer, water polo or other ball oriented sports with appropriate modifications of apparatus 10. In use, a ball, such as volleyball 152, is placed in ball support cup 158 on ball support arm 150. The height of ball 152 is then set by cranking handle 30, either to raise or lower inner upright support 24 and thereby ball 152. The angle at which the user desires to set ball 152 and arm 150 is set by means of knob 74 securing positioning plate 68 and locating disk 84 at a desired angle utilizing angle indicator markings 80 and pointer 82. The angle of cam support plate 78 is thereby altered which in turn determines the angularity of arm 150 and cam 130. The tension at which ball support arm 150 is held is adjusted by knob 120 to accommodate players of varying strengths and abilities. Apparatus 10 is then moved to a desired location on the court for training, practice, and monitoring. When the user strikes ball 152 perpendicular to base plate 78, that is the angle set by positioning plate 68 and locating disk 84, arm 150 and ball 152 will rotate smoothly around cam 130. However, if the ball is struck at an incorrect angle, that is, not perpendicular to base plate 78 and the angle set by locating disk 84 and positioning plate 68, arm 150 and ball 152 merely wobble up and down slightly but cannot rotate smoothly about cam 130. In this manner, the player or coach is instantly appraised of whether a correct or incorrect hit has been made. Further, since arm 150 is preferably flexible as is ball support cup 158, improper hits of ball 152 are emphasized and clearly apparent to the user. By adjusting the height of ball 152 correct jumping and positioning is learned with apparatus 10 and by adjusting the tension at which arm 150 is held power and strength conditioning means are also provided.

While the above description contains many specificities, they should not be construed as limitations on the scope of the invention, but merely as exemplifications of preferred embodiments thereof. Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the applicant's general inventive concept.

What is claimed is:

1. A volleyball training and monitoring apparatus, comprising:

a base, an upright support member connected to said base and extending upwardly from the base, said upright support member having an inner upright member slideably secured therein and extending upwardly therefrom, height adjustment means for said upright support member operably secured to the upright support member and to said inner upright member, means for supporting and positioning a volleyball, including arm means positioned in a generally horizontal orientation to the upright support member, means for controlling the position and movement of said volleyball comprising a cam and a spring loaded follower means operably secured to the upright support member, and to said arm means, and angle adjustment means for positioning and adjusting the arm means at a desired angle including positioning means and angle indicator means coupled thereto.

2. The volleyball training and monitoring apparatus of claim 1 wherein said means for adjusting the height of said upright support member comprises a handle secured to a notched element, said notched element is operably engaged with a gear, said gear being operably coupled with a sprocket engaged with said inner upright member.

3. The volleyball training and monitoring apparatus of claim 2 wherein said inner upright support member includes a plurality of apertures for operable engagement of said sprocket for adjusting the height of said upright support member.

4. The volleyball training and monitoring apparatus of claim 2 wherein said handle comprises a swivel handle.

5. The volleyball training and monitoring apparatus of claim 1 wherein said arm means comprises a flexible slotted arm having a volleyball retaining means secured at a terminal end thereof.

6. The volleyball training and monitoring apparatus of claim 5 wherein said means for controlling the position and movement of said volleyball further includes a compression spring means secured to a cam follower arm having a pivot mounted to a pivot block, said pivot block is secured to a plate means; said tension spring is springably engaged to adjustment knob means, allowing for control and monitoring of the volleyball movement and providing tension control means for said arm.

7. The volleyball training and monitoring apparatus of claim 1 wherein said positioning means comprises a positioning plate having angle markings thereon and locking means for securing said positioning plate at a desired angle.

8. The volleyball training and monitoring apparatus of claim 7 wherein said angle indicator means comprises a locating disk having a plurality of spaced detents thereon for positioning and alignment corresponding to said angle markings of said positioning plate, said locating disc is secured between said positioning plate and a backing plate.

9. The volleyball training and monitoring apparatus of claim 1 further including and adjustable net mounting means detachably secured to said upright support member, for operably securing a volleyball net to the upright support member.

10. A game ball support and training apparatus, comprising:

a base, an upright support member connected to said base and having extension means for raising and lowering said upright support member, height adjustment means operably secured to the upright support member for height adjustments of the upright support member, means for supporting and positioning said game ball including an arm positioned in a substantially horizontal orientation to the upright support member, means for controlling the position and movement of the game ball including a cam and tension control means operably attached to the upright support member and to said arm, and angle adjustment means for locating and positioning the arm at a desired angle, whereby the game ball may be positioned to simulate delivery of the game ball to a desired location.

11. The game ball support and training apparatus of claim 10 wherein said base comprises a triangulated frame having wheel means rotatably mounted thereon and a locking pivot wheel allowing for alignment on a game court or field.

12. The game ball support and training apparatus of claim 10 wherein said extension means comprises an inner upright member slideably secured within said upright support member.

13. The game ball support and training apparatus of claim 10 wherein said height adjustment means comprises a handle secured to a worm element, said worm element is operably coupled with a worm gear housing a sprocket engaged with said inner upright member.

14. The game ball support and training apparatus of claim 10 wherein said means for supporting and positioning said game ball comprises a flexible arm having slots therein to maintain said arm parallel to base plate means so that when the game ball is struck in a correct manner the impact imparts force perpendicular to said base plate rotating said cam.

15. The game ball support and training apparatus of claim 10 wherein said means for controlling the position and the movement of said game ball further includes a spring loaded follower means coupled to said cam; said spring loaded follower means are pivotally mounted to a pivot block and to adjustment knob means.

16. The game ball support and training apparatus of claim 10 wherein said angle adjustment means include a positioning means and angle indicator means.

17. The game ball support and training apparatus of claim 16 wherein said positioning means comprise a positioning plate having angel markings thereon and locking means for securing said positioning plate at a desired angle.

18. The game ball support and training apparatus of claim 16 wherein said angle indicator means comprise a locating disk having a plurality of spaced detents therein for positioning and alignment, said plurality of spaced detents positioned so as to correspond to said markings on said positioning plate.

* * * * *